US006467459B2

(12) United States Patent
Machida et al.

(10) Patent No.: US 6,467,459 B2
(45) Date of Patent: Oct. 22, 2002

(54) FUEL INJECTION CONTROL APPARATUS

(75) Inventors: Kenichi Machida; Yoshiaki Hirakata; Tomomi Yuhara; Masahiko Abe; Shiro Kokubu, all of Saitama (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/893,552

(22) Filed: Jun. 29, 2001

(65) Prior Publication Data

US 2002/0007822 A1 Jan. 24, 2002

(30) Foreign Application Priority Data

Apr. 23, 2000 (JP) ..... 2001-124480
Jun. 9, 2000 (JP) ..... 2000-196359

(51) Int. Cl.[7] ..... F02M 51/00
(52) U.S. Cl. ..... 123/492; 123/493
(58) Field of Search ..... 123/493, 492, 123/478, 494, 472; 701/104

(56) References Cited

U.S. PATENT DOCUMENTS 4,928,653 A * 5/1990 Ohkubo et al. ..... 123/435
5,193,509 A * 3/1993 Ohmori et al. ..... 132/493

FOREIGN PATENT DOCUMENTS

JP A4-365943 12/1992
JP 6-10437 2/1994

* cited by examiner

*Primary Examiner*—Bibhu Mohanty
(74) *Attorney, Agent, or Firm*—Birch, Stewart, Kolasch & Birch, LLP

(57) ABSTRACT

To change a fuel injection quantity to follow a throttle opening change in a low load region. A first calculator calculates a basic injection time using a throttle opening and an engine rotational speed. A second calculator calculates a basic injection time using an intake pipe negative pressure and the engine rotational speed. A selector selects the first calculator when the load is higher, and selects the second calculator when the load is lower. If the rate of change of the throttle opening is greater than a reference value, then a switcher sets the selector to select the first calculator. Thus, if the rate of increase of the throttle opening is greater than the reference value even when the load is low, the first calculator is selected.

12 Claims, 4 Drawing Sheets

FUEL INJECTION CONTROL APPARATUS

BACKGROUND OF THE INVENTION

1. Field of the Invention

The present invention relates to a fuel injection control apparatus, and more particularly to a fuel injection control apparatus for determining a basic injection quantity of fuel according to a process which is different depending on the extent of a load.

2. Description of Background Art

Heretofore, processes for measuring an amount of intake air relative to a basic injection quantity of fuel have been known. The known processes include a direct process of directly measuring an amount of intake air using an air flow meter, and an indirect process of indirectly measuring an amount of intake air using a throttle sensor or an intake pipe negative pressure sensor. For example, Japanese Patent Laid-open No. Hei 4-365943 discloses a fuel injection control apparatus for calculating an amount of intake air from a throttle opening and an engine rotational speed in a transient mode of operation and detecting an amount of intake air using an air flow meter in a normal mode of operation. Japanese Patent Publication No. Hei 6-10437 discloses an apparatus for measuring an amount of intake air selectively according to a direct process or an indirect process, and correcting a calculated basic fuel injection quantity upon switching between the processes.

For a fuel injection control for motorcycle engines, the indirect process of the above two processes is often employed. When the load is low, a basic injection quantity is calculated from the detected value from the intake pipe negative pressure sensor and the engine rotational speed, and when the load is high, a basic injection quantity is calculated from the detected value from the throttle sensor and the engine rotational speed. Whether the load is high or low is determined from the throttle opening per engine rotational speed.

With regard to a motorcycle, the drivability at the time the throttle valve is slightly opened from a fully closed position, i.e., the response to an action to open the throttle valve, plays an important role in the overall driving performance and the commercial value of the motorcycle. The intake pipe negative pressure sensor has a poor output response to a change in the negative pressure. Therefore, when the motorcycle is in a transient mode of operation, a fuel injection quantity calculated from the negative pressure and the engine rotational speed is not accurate enough, resulting in a failure to provide good drivability.

SUMMARY AND OBJECTS OF THE INVENTION

The present invention has been made to solve the above objects. It is an object of the present invention to provide a fuel injection control apparatus for an internal combustion engine which is capable of increasing the drivability by improving the ability of changes in a fuel injection quantity to follow a throttle action.

To achieve the above object, there is provided in accordance with a first feature of the present invention a fuel injection control apparatus having a throttle sensor and an intake passage negative pressure sensor, for calculating a basic injection quantity of fuel from a throttle opening or a negative pressure detected by the sensor and an engine rotational speed, characterized by including first calculating means for calculating a basic injection quantity using the throttle opening and the engine rotational speed, second calculating means for calculating a basic injection quantity using the negative pressure and the engine rotational speed, means for comparing a rate of increase of the throttle opening with a reference value, means for detecting a load, selecting means for selecting said first calculating means when the load is high and selecting said second calculating means when the load is low, and switching means for setting said selecting means to select said first calculating means regardless of the selection made by said selecting means if the load is low and the rate of increase of the throttle opening is greater than said reference value.

According to the first feature, if the rate of increase of the throttle opening is large even if the load is judged as being low, the first calculating means is selected, and a basic injection quantity of fuel is calculated from the throttle opening and the engine rotational speed. Therefore, good drivability can be realized regardless of the output response delay of the intake passage negative pressure sensor.

According to a second feature of the present invention, the fuel injection control apparatus is characterized by further including full closure detecting means for detecting when a throttle value is substantially fully closed, wherein if said full closure detecting means detects when the throttle value is substantially fully closed when said switching means sets said selecting means to select said first calculating means, said second calculating means is selected. According to the second feature, when an abrupt deceleration is made to substantially fully close the throttle valve, a resetting process is carried out to select the second calculating means to use the intake pipe negative pressure in order to allow the fuel injection quantity to be controlled depending on the abrupt deceleration.

According to a third feature of the present invention, the fuel injection control apparatus is characterized by further including returning means for switching to said second calculating means when said negative pressure is substantially in agreement with a reference negative pressure set depending on the throttle opening if the load is low and the rate of increase of the throttle opening is greater than said reference value, thereby selecting said first calculating means. According to the third feature, the second calculating means is selected when the intake pipe negative pressure detected by the negative pressure sensor is brought into substantial agreement with the preset reference negative pressure, following the throttle opening.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 2:
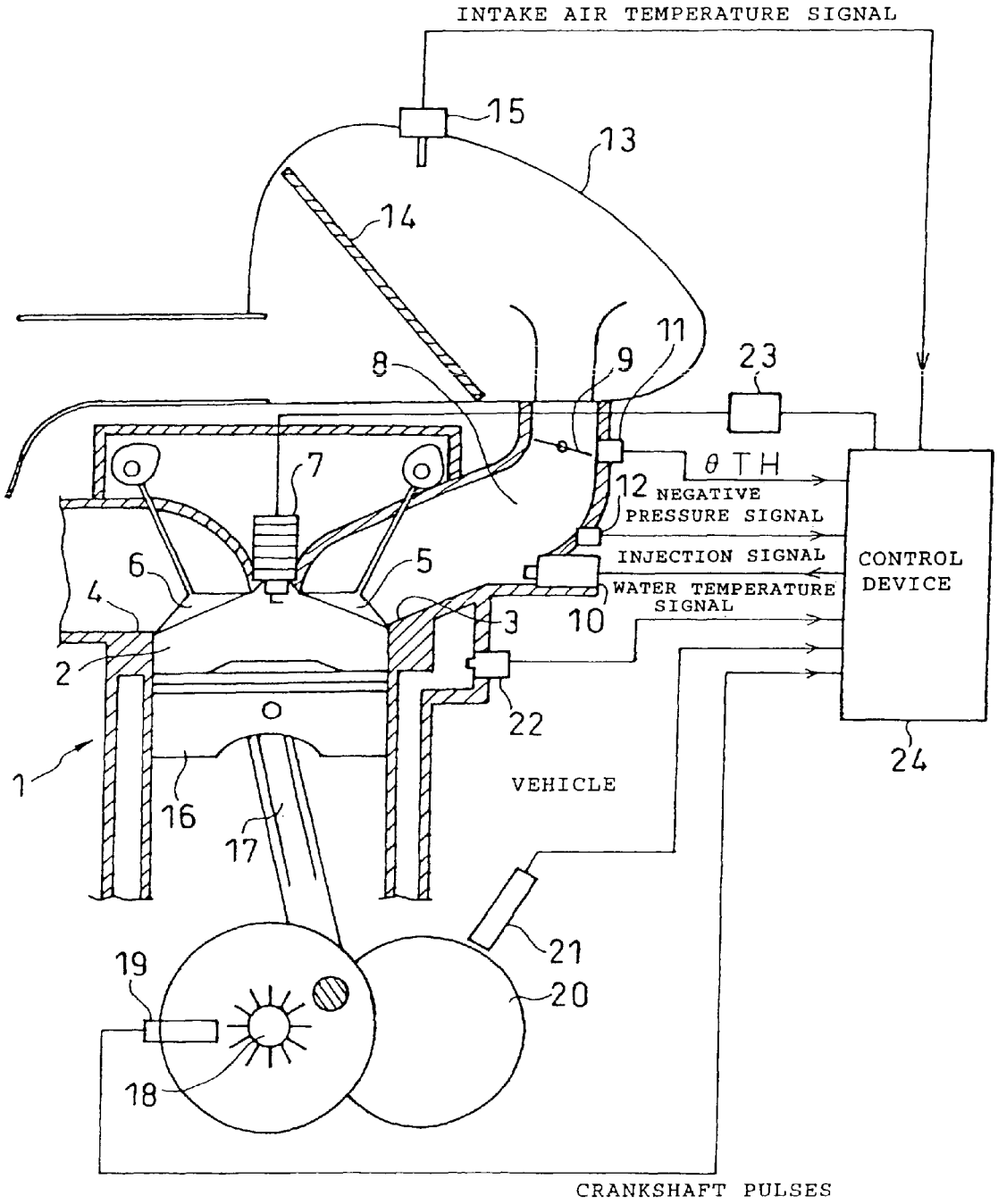
FIG. 2 is a view of an essential part of an internal combustion engine which incorporates the fuel injection control apparatus according to the present invention.

The present invention will be described below with reference to the drawings. FIG. 2 is a view of an essential part of an internal combustion engine which incorporates a fuel injection control apparatus according to an embodiment of the present invention. In FIG. 2, an intake port 3 and an exhaust port 4 are opened into a combustion chamber 2 of a cylinder 1, and an intake valve 5 and an exhaust valve 6 are disposed respectively in the intake port 3 and the exhaust port 4. An ignition plug 7 is disposed in the combustion chamber 2.

An intake passage 8 communicating with the intake port 3 has a throttle valve 9 for adjusting the amount of intake air depending on its opening θTH, a fuel injection valve 10, a throttle sensor 11 for detecting the opening θTH, and a negative pressure sensor 12. To the terminal end of the intake passage 8, there is connected an air cleaner 13 which houses an air filter 14 for introducing external air therethrough into the intake passage 8. An intake air temperature sensor 15 is disposed in the air cleaner 13.

The cylinder 1 houses a piston 16 therein which is connected to a crankshaft 18 via a connecting rod 17. A rotational angle sensor 19 is disposed in confronting relation to the crankshaft 18 for detecting a rotational angle of the crankshaft 18 and for outputting a crankshaft pulse for each given crankshaft angle. A vehicle speed sensor 21 is disposed in confronting relation to a rotatable body 20 such as a gear or the like that is coupled to the crankshaft 18. The cylinder 1 is surrounded by a water jacket having a water temperature sensor 22 for detecting the temperature of a coolant which represents an engine temperature. An ignition coil 23 is connected to the ignition plug 7.

A control device 24 comprises a microcomputer having a CPU and a memory, and has interface elements including input/output ports and an A/D converter. The control device 24 is supplied with electric energy from a battery, not shown. Output signals from the various sensors are supplied via the input ports to the control device 24. The control device 24 outputs drive signals to the fuel injection valve 10 and the ignition plug 7 according to processed results based on the input signals from the sensors. The drive signal (injection signal) for the fuel injection valve 10 is a pulse signal having a pulse duration depending on an injection quantity. The fuel injection valve 10 is opened for a time corresponding to the pulse duration to inject fuel into the intake passage 8.

The pulse duration of the injection signal, i.e., the fuel injection time, is calculated based on a detected value of the negative pressure sensor 12 (negative pressure Pb in the intake passage 8) and an engine rotational speed, or a detected value of the throttle sensor 11 (throttle opening θTH) and an engine rotational speed. In the present embodiment, basically, when the load is high, the throttle opening θTH and the engine rotational speed are used, and when the load is low, the negative pressure Pb and the engine rotational speed are used. Whether the load is high or low is determined from the throttle opening θTH. However, even when the throttle opening θTH is of such a value to judge the load as being low, the fuel injection time is calculated using the throttle opening θTH and the engine rotational speed, as when the load is high, depending on a rate of change DθTH of the throttle opening θTH.

Figure 3:
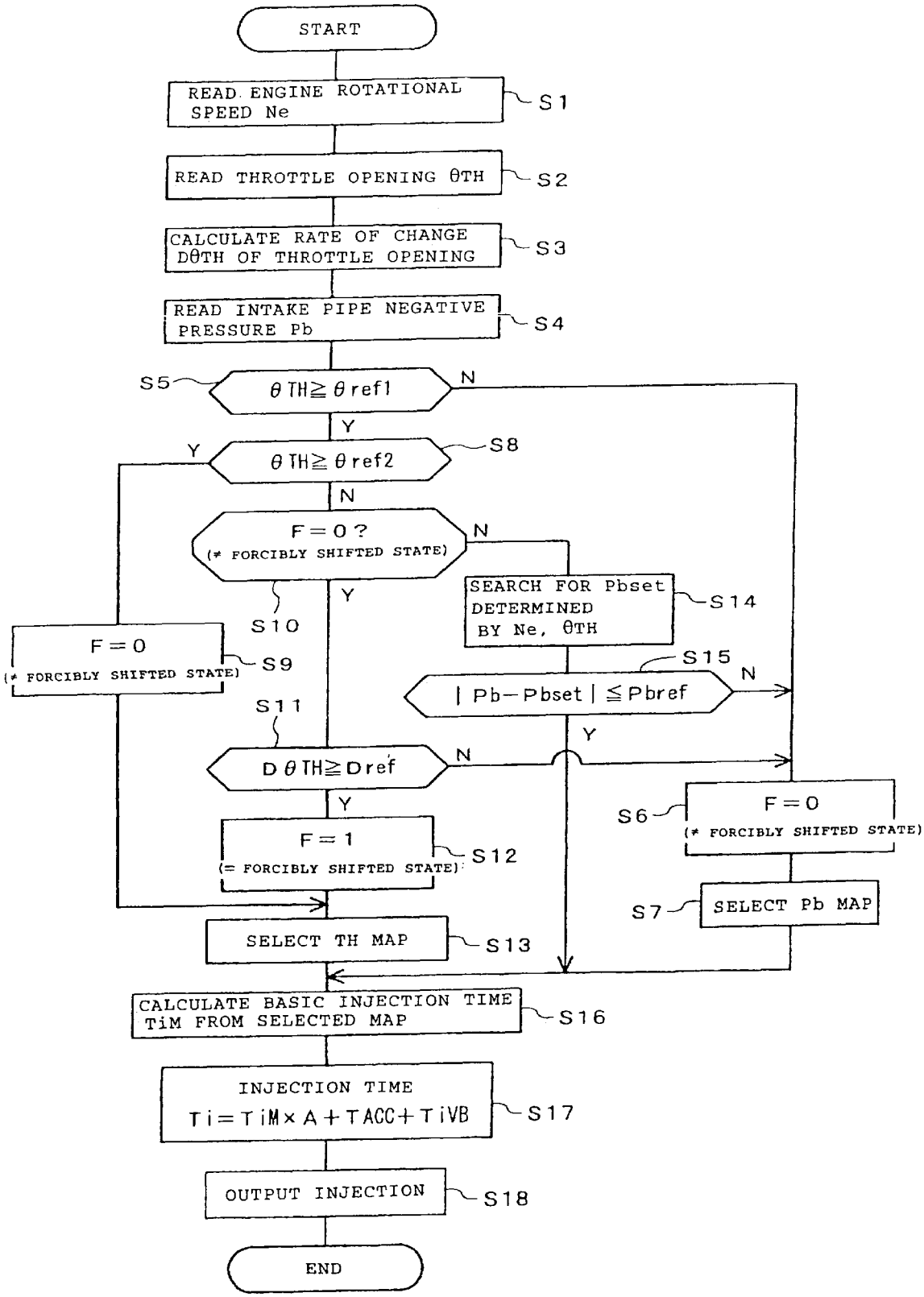
FIG. 3 is a flowchart of a fuel injection process.

FIG. 3 is a flowchart of a fuel injection process. In step S1, an engine rotational speed Ne is read. The engine rotational speed Ne is determined by counting crankshaft pulses outputted from the rotational angle sensor 19. In step S2, a throttle opening θTH is read. In step S3, a rate of change DθTH of the throttle opening θTH is calculated. The rate of change DθTH of the throttle opening θTH is calculated based on a value θTH1 of the throttle opening θTH previously processed a predetermined time ΔT and a value θTH2 of the throttle opening θTH processed at present time according to the following equation (f1):

The rate of change $$D\theta TH=(\theta TH2-\theta TH1)/\Delta T \quad \text{(f1).}$$

In step S4, a detected value of the negative pressure sensor 12, i.e., an intake pipe negative pressure Pb, is read. In step S5, it is determined whether or not the throttle opening θTH is equal to or greater than a first set value θref1 for determining whether the load is low or not. The first set value θref1 is stored as a function of the engine rotational speed Ne. If the answer to step S5 is negative, i.e., if the throttle opening θTH is slight or fully closed, then a flag F representative of a forcibly shifted state is set to "0" in step S6, and then a PB map is selected in step S7. The PB map is a map for calculating a basic injection time TiM as a function of the engine rotational speed Ne and the negative pressure Pb. Since the injection quantity corresponds to the injection time, the injection time will be described as representing the injection quantity.

If the answer to step S5 is affirmative, then it is determined in step S8 whether or not the throttle opening θTH is equal to or greater than a second set value θref2 (θref2>θref1) for determining whether the load is high or not. As with the first set value θref1, the second set value θref2 is stored as a function of the engine rotational speed Ne. If the answer to step S8 is affirmative, then the flag F is set to "0" in step S9, and thereafter a TH map is selected in step S13. The TH map is a map for calculating a basic injection time TiM as a function of the engine rotational speed Ne and the throttle opening θTH.

If the throttle opening θTH is equal to or greater than the first set value θref1, but does not reach the second set value θref2, then control goes to step S10 to determine whether the flag F is "0" or not, i.e., whether a forcibly shifted state is not to take place or not. If the flag F is "0", then control goes to step S11 to determine whether or not the rate of change DθTH of the throttle opening θTH is equal to or greater than a set value Dref. If the rate of change DθTH is equal to or greater than the set value Dref, then the answer to step S11 is affirmative, and control goes to step S12 in which the flag F is set to "1" indicating a forced shift to a control process under the high load. Thereafter, control goes to step S13. Specifically, if the rate of change DθTH of the throttle opening θTH is large, then the TH map is forcibly selected. If the rate of change DθTH is less than the set value Dref, then the load is regarded as being low, and control goes from step S11 to step S6 and then to step S7 to select the PB map.

If the throttle opening θTH falls between the first set value θref1 and the second set value θref2, and is under a forcibly shifted state, i.e., after control goes via step S11 to step S13, the answer to step S10 is negative, and control proceeds to the processing in steps S14, S15. In steps S14, S15, it is determined whether the intake pipe negative pressure Pb has caught up with a throttle opening change and approached a value presumed to be generated in a normal state with respect to the engine rotational speed Ne and the throttle opening θTH at the time. The intake pipe negative pressure Pb in the normal state may be set as a map.

Figure 4:
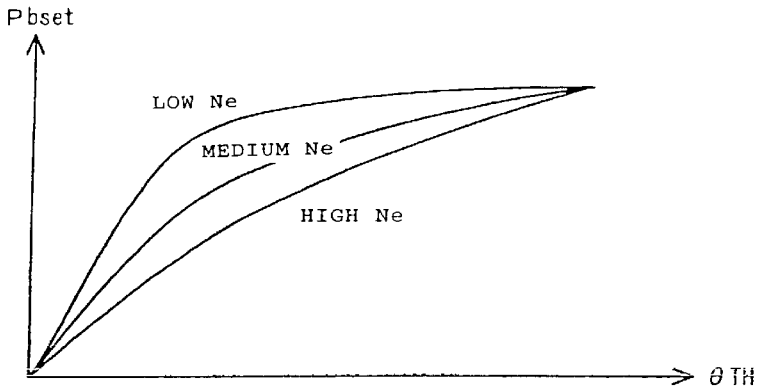
FIG. 4 is a diagram showing the relationship between intake pipe negative pressures and throttle openings in a normal mode of operation.

FIG. 4 is a diagram showing intake pipe negative pressure set values Pbset corresponding to the throttle opening θTH in respective engine rotational speed ranges. In step S14, a intake pipe negative pressure set value Pbset based on the engine rotational speed Ne and the throttle opening θTH is searched for from the map shown in FIG. 4. In step S15, it is determined whether or not the absolute value of the difference between the intake pipe negative pressure Pb and the intake pipe negative pressure set value Pbset is equal to or smaller than a comparative value Pbref. If the decision in step S15 is negative, then control goes to step S6, canceling the forcibly shifted state and selecting the Pb map. If the decision in step S15 is affirmative, then the forcibly shifted state is maintained.

In step S16, a basic injection time TiM is calculated from a map (PB map) of injection times with the engine rotational speed Ne and the negative pressure Pb used as parameters, or a map (TH map) of injection times with the engine rotational speed Ne and the throttle opening θTH used as parameters.

In step S17, the basic injection time TiM is multiplied by a corrective coefficient A, and then an acceleration corrective quantity TACC and an invalid injection time TiVB are added to calculate a fuel injection time Ti. The corrective coefficient A is a function of an engine coolant temperature, an intake air temperature, or the like, and may be calculated according to a predetermined equation based on output signals from the water temperature sensor 22 and the intake air temperature sensor 15, or may be determined by referring to a table of coefficients corresponding to engine coolant temperatures and intake air temperatures.

The acceleration corrective quantity TACC is calculated depending on the rate of change of the throttle opening. The invalid injection time TiVB represents a time in the valve opening time where full fuel injection does not take place, and is determined by the type and structure of the fuel injection valve 10.

In step S18, a drive signal for the fuel injection valve 10 is outputted during the fuel injection time Ti. While the drive signal is being outputted, the fuel injection valve 10 is opened to inject fuel into the intake passage 8.

Figure 5:
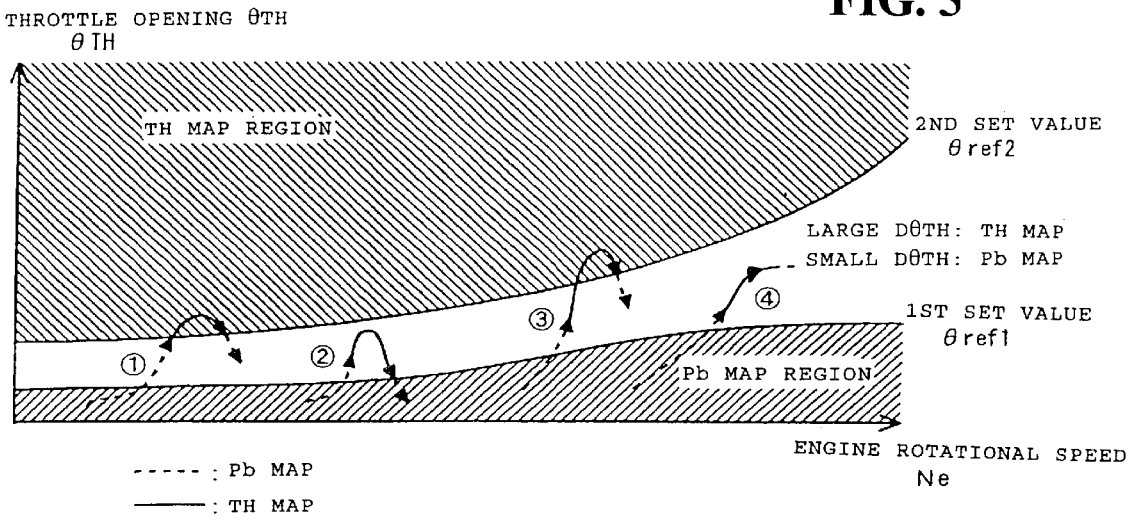
FIG. 5 is a diagram showing a general concept of a control for switching between a PB map region and a TH map region.

FIG. 5 is a diagram showing regions of the PB map and the TH map with the engine rotational speed Ne and the throttle opening θTH used as parameters. FIG. 5 illustrates a region where the throttle opening θTH is larger as the region of the TH map, and a region where the throttle opening θTH is smaller as the region of the PB map.

Between the region of the TH map and the region of the PB map, there is a transient region which is not fixed to either of these regions. Depending on the magnitude of the rate of change DθTH of the throttle opening θTH, the transient region forcibly changes to the PB map region if the rate of change DθTH is less than the set value Dref, and forcibly changes to the TH map region if the rate of change DθTH is equal to or greater than the set value Dref.

For example, if the rate of change DθTH is less than the set value Dref while in the transient region, then the TH map is selected when the throttle opening θTH exceeds the second set value θref2, and the PB map is selected when the throttle opening θTH thereafter becomes smaller than the second set value θref2 (Example 1 illustrated inside a circle). If the rate of change DθTH is equal to or greater than the set value Dref while in the transient region, then a forced shift occurs to the TH map region even when the throttle opening θTH has not reached the second set value θref2. The PB map is selected when the rate of change DθTH thereafter becomes lower than the first set value θref1 without exceeding the second set value θref2 (Example 2 illustrated inside a circle).

If the rate of change DθTH is equal to or greater than the set value Dref while in the transient region, then a forced shift occurs to the TH map region even when the throttle opening θTH has not reached the second set value θref2. The PB map is selected at the time the throttle opening θTH thereafter exceeds the second set value θref2 and then becomes lower than the second set value θref2 again (Example 3 illustrated inside a circle).

If the load is low, and the rate of change DθTH is greater than the set value Dref with the TH map selected, then the TM map switches to the PB map when the negative pressure Pb becomes substantially the same as a reference negative pressure that has been set depending on the throttle opening θTH (Example 4 illustrated inside a circle).

Figure 1:
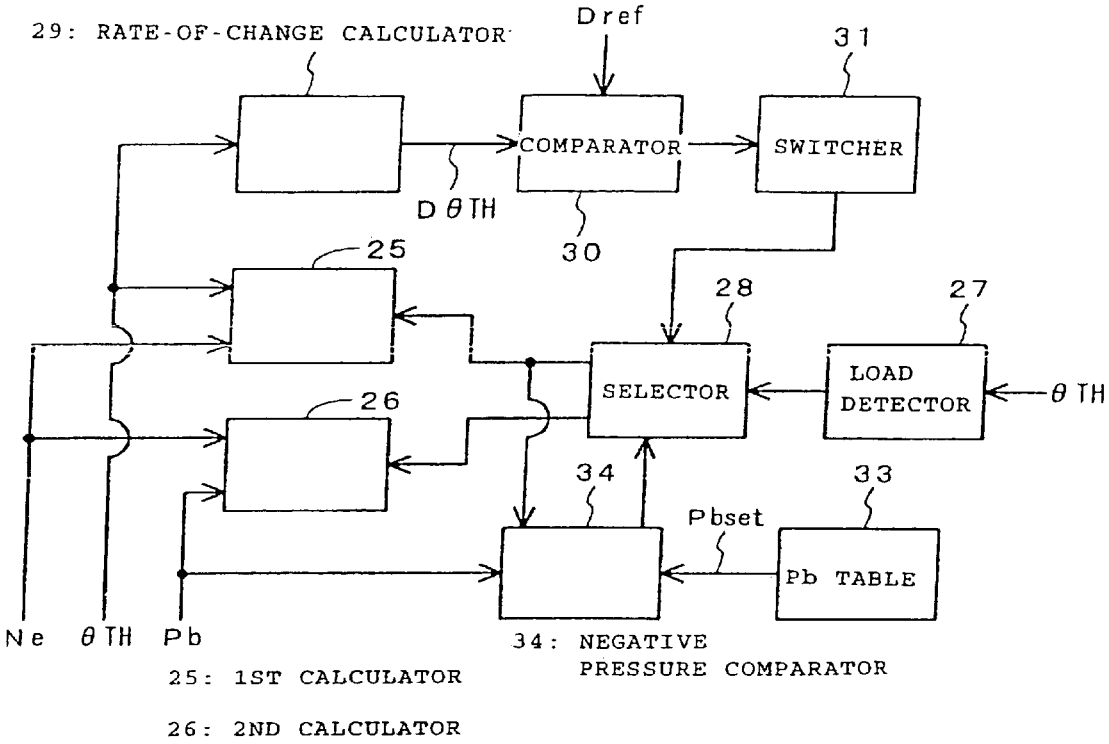
FIG. 1 is a block diagram of essential functions of a fuel injection control apparatus according to an embodiment of the present invention.

FIG. 1 is a block diagram showing essential functions of the fuel injection control apparatus according to the embodiment of the present invention. In FIG. 1, a first calculator 25 calculates a basic injection time using the throttle opening θTH and the engine rotational speed Ne. A second calculator 26 calculates a basic injection time using the intake pipe negative pressure Pb and the engine rotational speed Ne. A load detector 27 determines a load depending on whether the throttle opening θTH is equal to or greater than an upper set value (θref2), or is equal to or less than a lower set value (θref1), or between these set values. A selector 28 selects the first calculator 25 when the load is higher, i.e., when the throttle opening θTH is equal to or greater than the upper set value θref2, and selects the second calculator 26 when the load is lower, i.e., when the throttle opening θTH is equal to or greater than the lower set value θref1.

A rate-of-change calculator 29 calculates a rate of change of the throttle opening. A comparator 30 supplies a detected output to a switcher 31 if the rate of change DθTH of the throttle opening is greater than the reference value Dref. The switcher 31 causes the selector 28 to select the first calculator 25 in response to the detected output. Specifically, if the rate of increase of the throttle opening is greater than the reference value even when the load is low, the switcher 31 forcibly sets the selector 28 to select the first calculator 25 regardless of the above selective reference.

A Pb table 33 stores an intake pipe negative pressure set value Pbset with respect to the throttle opening θTH every engine rotational speed Ne. When the first calculator 25 is selected, the Pb table 33 is referred to, and an intake pipe negative pressure set value Pbset is read therefrom based on the throttle opening θTH and the engine rotational speed Ne. The intake pipe negative pressure set value Pbset is compared with the intake pipe negative pressure Pb by a negative pressure comparator 34. When the intake pipe negative pressure set value Pbset and the intake pipe negative pressure Pb are in substantial agreement with each other, the selector 28 is set to select the second calculator 26.

As described above, according to the present invention, even if the load is low, i.e., even if the throttle opening is small, an injection quantity is calculated using the throttle opening as the throttle opening changes in the same manner as when the load is high. Therefore, a change in the fuel injection quantity can catch up with a throttle action without a delay. As a result, good drivability can be realized regardless of the output response delay of the intake passage negative pressure sensor.

According to the present invention, the drivability upon deceleration is increased. According to the present invention, when the intake pipe negative pressure detected by the negative pressure sensor follows the throttle valve and becomes substantially the same as the predetermined reference negative pressure, the second calculator using the intake pipe negative pressure is selected for stabilizing fuel injection control.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A fuel injection control apparatus having a throttle sensor and an intake passage negative pressure sensor, for calculating a basic injection quantity of fuel from a throttle opening or a negative pressure detected by the sensor and an engine rotational speed comprising:

first calculating means for calculating a basic injection quantity using the throttle opening and the engine rotational speed;

second calculating means for calculating a basic injection quantity using the negative pressure and the engine rotational speed;

means for comparing a rate of increase of the throttle opening with a reference value;

means for detecting a load;

selecting means for selecting said first calculating means when the load is high and selecting said second calculating means when the load is low; and switching means for setting said selecting means to select said first calculating means regardless of the selection made by said selecting means if the load is low and the rate of increase of the throttle opening is greater than said reference value.

2. The fuel injection control apparatus according to claim 1, and further including full closure detecting means for detecting when a throttle value is substantially fully closed, wherein if said full closure detecting means detects when the throttle value is substantially fully closed when said switching means sets said selecting means to select said first calculating means, said second calculating means is selected.

3. The fuel injection control apparatus according to claim 1, and further including returning means for switching to said second calculating means when said negative pressure is substantially in agreement with a reference negative pressure set depending on the throttle opening if the load is low and the rate of increase of the throttle opening is greater than said reference value, thereby selecting said first calculating means.

4. The fuel injection control apparatus according to claim 1, wherein said means for comparing a rate of increase of the throttle opening includes a microcomputer for receiving input signals from the first calculating means, the second calculating means, the means for detecting a load and for outputting a drive signal to a fuel injection valve and an ignition plug.

5. A fuel injection control apparatus having a throttle sensor and an intake passage negative pressure sensor, for calculating a basic injection quantity of fuel from at least one of a throttle opening and a negative pressure detected by the sensor and an engine rotational speed comprising:

first calculating means for calculating a basic injection quantity using the throttle opening and the engine rotational speed;

second calculating means for calculating a basic injection quantity using the negative pressure and the engine rotational speed;

means for comparing a rate of increase of the throttle opening with a reference value;

means for detecting a load;

selecting means for selecting said first calculating means when the load is above a first predetermined load and selecting said second calculating means when the load is below a second predetermined load; and switching means for setting said selecting means to select said first calculating means regardless of the selection made by said selecting means if the load is below a second predetermined load and the rate of increase of the throttle opening is greater than said reference value.

6. The fuel injection control apparatus according to claim 5, and further including full closure detecting means for detecting when a throttle value is substantially fully closed, wherein if said full closure detecting means detects when the throttle value is substantially fully closed when said switching means sets said selecting means to select said first calculating means, said second calculating means is selected.

7. The fuel injection control apparatus according to claim 5, and further including returning means for switching to said second calculating means when said negative pressure is substantially in agreement with a reference negative pressure set depending on the throttle opening if the load is below the second predetermined load and the rate of increase of the throttle opening is greater than said reference value, thereby selecting said first calculating means.

8. The fuel injection control apparatus according to claim 5, wherein said means for comparing a rate of increase of the throttle opening includes a microcomputer for receiving input signals from the first calculating means, the second calculating means, the means for detecting a load and for outputting a drive signal to a fuel injection valve and an ignition plug.

9. A method for controlling a fuel injection control apparatus having a throttle sensor and an intake passage negative pressure sensor, for calculating a basic injection quantity of fuel from at least one of a throttle opening and a negative pressure detected by the sensor and an engine rotational speed comprising the following steps:

calculating a basic injection quantity using the throttle opening and the engine rotational speed;

calculating a basic injection quantity using the negative pressure and the engine rotational speed;

comparing a rate of increase of the throttle opening with a reference value;

detecting a load;

selecting said calculating a basic injection quantity using the throttle opening and the engine rotational speed when the load is above a first predetermined load and selecting said calculating a basic injection quantity using the negative pressure and the engine rotational speed when the load is below a second predetermined load; and switching to select said calculating a basic injection quantity using the throttle opening and the engine rotational speed regardless of the selection made by said selecting step if the load is below a second predetermined load and the rate of increase of the throttle opening is greater than said reference value.

10. The method for controlling fuel injection according to claim 9, and further including the step of detecting when a throttle value is substantially fully closed, wherein if said throttle value is substantially fully closed when said switching step sets said selecting means to select said first calculating means, said calculating the basis injection quantity using the negative pressure and the engine rotational speed is selected.

11. The method for controlling fuel injection according to claim 9, and further including switching to said calculating the basis injection quantity using the negative pressure and the engine rotational speed when said negative pressure is substantially in agreement with a reference negative pressure set depending on the throttle opening if the load is below the second predetermined load and the rate of increase of the throttle opening is greater than said reference value, thereby selecting said first calculating means.

12. The method for controlling fuel injection according to claim 9, wherein said comparing a rate of increase of the throttle opening includes a microcomputer for receiving input signals from the first calculating means, the second calculating means, the means for detecting a load and for outputting a drive signal to a fuel injection valve and an ignition plug.

* * * * *

UNITED STATES PATENT AND TRADEMARK OFFICE

CERTIFICATE OF CORRECTION

PATENT NO. : 6,467,459 B2
DATED : October 22, 2002
INVENTOR(S) : Kenichi Machida et al.

It is certified that error appears in the above-identified patent and that said Letters Patent is hereby corrected as shown below:

Title page,
Item [30], Foreign Application Priority Data, please replace

"Apr. 23, 2000 (JP) ..... 2001-124480
Jun. 9, 2000 (JP) ..... 2000-196359"

with

-- Apr. 23, 2001 (JP) ..... 2001-124480
Jun. 29, 2000 (JP) ..... 2000-196359 --.

Signed and Sealed this

Seventeenth Day of June, 2003

JAMES E. ROGAN
*Director of the United States Patent and Trademark Office*